US005399306A

United States Patent [19]

Follows et al.

[11] Patent Number: 5,399,306

[45] Date of Patent: Mar. 21, 1995

[54] PRODUCTION OF NYLON YARN

[75] Inventors: Gordon W. Follows, Cleveland; Michael P. Wilson, Cheltenham; John Richardson, Churchdown, all of United Kingdom

[73] Assignee: E. I. Du Pont de Nemours and Company, Wilmington, Del.

[21] Appl. No.: 923,900

[22] PCT Filed: Feb. 7, 1991

[86] PCT No.: PCT/GB91/00191

§ 371 Date: Oct. 21, 1992

§ 102(e) Date: Oct. 21, 1992

[87] PCT Pub. No.: WO91/13194

PCT Pub. Date: Sep. 5, 1991

[30] Foreign Application Priority Data

Feb. 22, 1990 [GB] United Kingdom ..... 9004048

[51] Int. Cl.[6] ..... D01D 5/12; D01F 6/60; D02G 1/00; D02J 1/22

[52] U.S. Cl. ..... 264/103; 264/168; 264/210.6; 264/210.8; 264/211; 524/606; 528/323; 528/324; 528/335; 528/336

[58] Field of Search ..... 264/103, 168, 210.6, 264/210.8, 211; 524/606; 528/323, 324, 335, 336

[56] References Cited

U.S. PATENT DOCUMENTS

| | | | |
|---|---|---|---|
| 3,707,522 | 12/1972 | Simons | 524/606 |
| 4,457,883 | 7/1984 | Howse et al. | 264/168 |

FOREIGN PATENT DOCUMENTS

| | | |
|---|---|---|
| 159635 | 10/1985 | European Pat. Off. . |
| 245070 | 11/1987 | European Pat. Off. . |
| 245072 | 11/1987 | European Pat. Off. . |
| 1016562 | 1/1966 | United Kingdom . |
| 1126213 | 9/1968 | United Kingdom . |

*Primary Examiner*—Leo B. Tentoni

[57] ABSTRACT

Nylon carpet or textile yarn may be produced at an increased rate of throughput/spinneret hole by incorporating into nylon 6.6 polymer a secondary component which improves processability and lustre by suppressing spherulitic growth. The secondary component may be a co-monomer (e.g. hexamethylene diamine/isophthalic acid) which is incorporated during polymerisation to form a random co-polymer, a polymer (e.g. nylon 6) which is molecularly dispersed in the nylon 6.6 polymer without significant copolymerisation occurring or a metal salt (e.g. lithium chloride).

9 Claims, No Drawings

PRODUCTION OF NYLON YARN

This invention relates to improvements in the production of nylon yarn for carpet and textile purposes.

Typical bulked continuous filament (BCF) carpet yarns (i.e. yarn having a decitex per filament (or dpf) of 15 or more) may be produced, and in this specificiation are defined as being so produced, using spin-draw-bulk processes in which the filaments, after being melt-extruded through the spinneret, and cooled in the spinning chimney, are converged to form the yarn which is fed to a feed-roll and then to one or more draw rolls having a surface speed higher than that of the feed roll dependent on the draw ratio required. Finally, the yarn is bulked (textured) by, for example, being passed into a bulking jet or by any other conventional texturing method.

Textile yarns may be produced, and in this specification are defined as being so produced using a POY (Partially Oriented Yarn) process in which the filaments, after being extruded, cooled and converged, are wound-up so that the resulting yarn is partially drawn (oriented) in a single stage.

Regardless of the type of process, for each filament the mass wound up per unit time must on average equal the mass per unit time extruded through the corresponding spinneret hole, and hence for a given filament $$\frac{\text{Decitex}}{10{,}000} \times \text{Wind-up Speed (meters/min)} = \text{Throughput (g/min)}$$

Thus to improve the productivity of the process, either in terms of a yarn of a given dpf at an increased wind-up speed (WUS) or a yarn of increased dpf at a given WUS, the throughput/hole needs to be increased.

However, at a given WUS increasing the throughput/hole leads (other things being equal) to slower filament cooling and hence a greater distance and time from the spinneret is necessary for the filament to reach a given temperature. This results in a less stable threadline. Moreover in polymers such as nylon 6.6, spherulitic crystallisation half-times are of a similar order or less than the times needed to cool spinning threadlines to below their glass transition temperature (Tg). This also leads to increased opportunity for crystallisation, in particular for the growth of spherulites in the hot unoriented parts of the threadline.

Spherulites are essentially spherical structures based on a crystalline framework which grow from a nucleus to give, in nylon 6.6, microscopically distinctive zones which may be several microns in diameter. They are described in more detail in e.g. Macromolecular Physics by B Wunderlich Vol 1 Academic Press 1973.

Spherulites are undesirable because they can affect the tensile properties (and hence the drawing performance) and the lustre of the filament.

A reduction in the tensile properties of a spun yarn can readily lead to breakage of filaments during drawing, which in turn may render that process unworkable or commercially uneconomic. Lustre is an important aspect of the visual aesthetics of a yarn and is a measure of the degree to which a yarn reflects and scatters light, which may vary from the smooth mirror-like to the rough or chalk-like.

Lustre may be quantified by its Half Peak Width (HPW) value, more mirror-like lustre giving lower HPW values. Reference may be made to GB Patent Specification No 2190190 for a description of Half Peak Width (HPW), its photogoniometric method of measurement and related parameters such as the peak intensity (Imax) of the photogoniometric curve.

The reflection and scattering of light by filaments is of course also strongly affected by the level of any delustrant, such as $TiO_2$, which may be included. However, such delustrants are not optically equivalent to the rough surface resulting from the presence of spherulites. $TiO_2$ tends to reduce the peak intensity in the photogoniometric curve but not change HPW. Spherulites tend to change both parameters with low peak intensities accompanying high HPW. Thus HPW is indicative of the effect of spherulites on lustre even in the presence of $TiO_2$.

Of course, unlike spherulites, properly incorporated $TiO_2$ has negligible effect on the tensile properties.

There is no hard and fast rule as to the number and size of spherulites acceptable in a nylon 6.6 spinning process. What is acceptable in a 20 dpf carpet process may be unacceptable in a finer filament textile yarn process. Thus for example $>2°$ HPW may prove to be unacceptable in a high speed textile hosiery yarn process but up to 10° HPW may be acceptable in a lower speed carpet yarn process. This not only reflects the different optical properties but also the robustness and size of the different filaments and the stresses imposed both in yarn production and subsequent processing. What is well known to those skilled in the art is that other things being held constant, increasing throughput/hole in nylon 6.6 processes gives filaments with increased size and number of spherulites and that at some point processing through subsequent drawing stages becomes commercially unrunnable and/or the optical properties become unacceptable.

Since the slower cooling of the filament is the main reason for the increased spherulitic growth, it will be apparent that such growth will be reduced by measures which increase cooling rate. Such measures could be, for example, increasing filament melt viscosity by raising the degree of polymerisation or significantly increasing the normal spinning speed of up to 1000 m/min for carpet yarn processes and circa 5000 m/min for textile yarn processes.

However, although apparently capable of effecting a solution, neither of these measures is fully satisfactory because of the effect on process cost and performance and product quality.

It is clearly a major advantage to a manufacturer if higher throughput processes can be achieved using existing polymer making and fibre spinning equipment, with as little modification as possible. A significant increase in polymer viscosity from existing levels, typically 40–55RV, makes this very difficult or impossible to achieve, particularly when batch autoclave polymerisation and/or steam blanketed polymer chip melters are used. In any case increasing the degree of polymerisation will, other things being equal, increase the costs of polymer making, and involve some loss of quality because of the longer times and/or additional processes involved.

There are also constraints against an increase in the speed at which the extruded filaments are wound-up (i.e. the speed of the feed rolls in the carpet process and the speed of the wind-up rolls in the textile process).

In the case of the carpet process an increase in feed roll speed leads to a reduction in draw ratio. Hence the yarn is relatively underdrawn which leads to an increased tendency for unstable running on the hot draw rolls and dye uptake variability in the bulked yarn. In the limiting case of a process running at maximum throughput/hole with nylon 6.6, such as that described in Example 6, increasing throughput/hole and increasing the speed of the feed and draw rolls proportionally, leads to filament breakage. Trying to eliminate this effect by a more than proportional increase in feed roll speed leads to the problems outlined above.

In the case of the textile process, there are difficulties in achieving speeds above 5,000 meters/minute. At the best, considerable investment in new equipment would be required.

It is an object of this invention to achieve an increased rate of production using conventional equipment and processes. However, the invention is not limited to such equipment and processes and can provide a benefit to any nylon 6.6 process where the presence of spherulites generates processing and lustre problems.

According to one aspect of the invention, there is provided a method of producing nylon carpet yarn by a spin-draw-bulk process or nylon textile yarn by a POY process (which processes are as herein defined) characterised in that nylon 6.6 polymer having incorporated therein a secondary component which improves processability and lustre by suppressing spherulitic growth and which is selected from a) a lactam or di-amine, di-acid co-monomer which is incorporated during polymerisation to form a random copolymer;

b) a polymer which is molecularly dispersed in the nylon 6.6 without significant copolymerisation occurring, or c) a metal salt soluble in nylon 6.6, is extruded at a throughput of greater than 4.5 g/hole/minute in the carpet process and greater than 3.5 g/hole/minute in the textile process.

It will be obvious to those skilled in the art that increasing the proportions of the secondary component will also tend to move the properties of the resultant yarn away from those of unmodified nylon 6.6. The secondary component should maximise the benefits in terms of increased processability and lustre while minimising, or keeping within acceptable limits, any undesirable effects.

In the case of the co-monomer it is well known that in most cases random copolymerisation of nylon 6.6 with a secondary component reduces the melting point. The secondary component should have a maximum effect on reducing the spherulitic growth rate and a minimum, or acceptable effect on melting point and related phenomena.

Spherulitic growth rates and nucleations densities may be measured using a hot stage microscope. However, the readiness of polymer to crystallise and thus the tendency of spherulites to occur may be more quickly and conveniently assessed by considering the degree of supercooling which occurs before the maximum rate of crystallisation is achieved when a sample is cooled at a standard rate from standard melting conditions e.g. in a Differential Scanning Calorimeter (DSC). It is recognised that such crystallisation depends on nucleation density as well as growth rate and occurs under conditions different from those pertaining in a spinning threadline. Nevertheless it has been found that the DSC may be used as a first guide to effectiveness of the secondary component.

According to a further preferred aspect of the invention, the co-monomer has an efficiency in retarding crystallisation such that $$\frac{\Delta(T_m - T_c)}{W} \div \frac{\Delta T_m}{W} \geqq 0.6$$

and $$\frac{\Delta(T_m - T_c)}{W} \geqq 0.5$$

where $T_m$=the temperature in °C. corresponding to the peak of the endotherm associated with melting during the heating cycle.

$T_c$=the temperature in °C. corresponding to the peak of the exotherm associated with crystallisation during the cooling cycle $(T_m-T_c)$=degree of supercooling $\Delta(T_m-T_c)$=increase in supercooling produced by the $$\frac{\Delta(T_m - T_c)}{W} = \text{increase in supercooling per unit weight of the co-monomer}$$

$\Delta T_m$=reduction in the melting point as compared to a nylon 6.6 control $\Delta T_m/W$=reduction in the melting point per unit weight of the co-monomer, Should the polymer melting point increase due to incorporation of the co-monomer, as occurs for example with 66/6T random copolymers, then the negative sign associated with $\Delta T_m/W$ should be ignored.

Preferably, the comonomer is hexamethylene diamine/isophthalic acid (6.iP), hexamethylene diamine/1,1,3-trimethyl-3-phenyl indane 4,5 dicarboxylic acid (6.PIDA), isophorone diamine/isophthalic acid (IPD.iP), bis(aminomethyl) tricyclodecane/isophthalic acid (TCD.iP), bis(aminomethyl) tricyclodecane/-terephthalic acid (TCD.T) or metaxylylene diamine/adipic acid (MXD.6) and is present in an amount up to 30%, preferably 5 to 30%, by weight.

The use of a molecular dispersion of a second polymer in the nylon 6.6 has the advantage that the dispersion can be produced by simple blending of the second polymer with the nylon 6.6 at any time prior to extrusion. Particularly beneficial is that the melting point of commercially useful blends (i.e. blends that give reduced spherulitic growth rate and improved lustre and processability) may only vary slightly from that of 100% nylon 66. Thus in a melt spinning process, the processing conditions for such blends may be the same as those for 100% nylon 6.6. This is of special advantage when a number of machines in a factory have a common heating system as it is possible to spin 100% nylon 6.6 on some and blends on others.

Moreover, the substantially unchanged melting point allows carpet yarn bulking to proceed at temperature and conditions used for 100% nylon 6.6, rather than at the lower temperature needed to avoid filament to filament welding which occurs with lower melting point compositions.

In practice the result of this is that blends may readily be used to produce yarns which match both the bulk level (EK) and bulk stability to tension (KB) of 100% nylon 6.6 yarns.

Bulk level (EK %) and bulk stability to tension (KB %) are assessed using a "crimp contraction test". This is based on DIN 53 840, with some important modifications. A hank of the yarn to be tested is produced on a reel of 1 m circumference with as many turns as is necessary to give a total count as close as possible to 250 tex. This hank, together with comparitive hanks, is then immersed in boiling water for 15 mins to develop any latent bulk (no restraining load is applied). On removal from the water the hank is dried in an air oven at 60° C. for 30 mins and then conditioned for at least 16 hours in a standard laboratory atmosphere (22° C., 65% rh). EK % and KB % are then measured in the following way in the same laboratory atmosphere (these measurements may conveniently be carried out using a 'Texturmat M' tester, manufactured by H Stein GmbH & Co KG Regentenstr, 37–39, D-4050 Münchengladbach 1, Germany). The hank is loaded with 250 cN, i.e. ca 1cN/tex; length $l_1$ is measured after 10 seconds. Loading is then reduced to 2.5cN i.e. 0.01cN/tex and length $l_2$ measured after 10 mins. Loading is then increased to 2500cN i.e. ca 10cN/tex for 10 seconds, and then reduced again to 2.5cN. After 10 minutes length $l_3$ is measured.

$$EK\ \% = \frac{(l_1 - l_2)100}{l_1}$$

$$KB\ \% = \frac{(l_1 - l_3)100}{(l_1 - l_2)}$$

Preferred second polymers are nylon 6, nylon 11, nylon 12, nylon 6.10 and nylon 6.iP (or mixture thereof) which may again be present up to about 30%, preferably 5 to 30%, by weight.

The degree to which copolymerisation has occurred can be established using $^{13}C$ NMR analysis.

The carbonyl groups present resonate differently depending on their configuration relative to the other atoms of the polymer chain. Thus, it is possible to differentiate between carbonyl groups linking units of nylon 6.6 with units of the second polymer (i.e. carbonyl groups involved in copolymerisation) and carbonyl groups linking two nylon 6.6 units or carbonyl groups linking two units of the second polymer, and hence, calculate the number of 'copolymer carbonyl groups' as a percentage of the total number of carbonyl groups. A degree of copolymerisation greater than 2% is detectable using this technique.

For more information, reference may be made to the article by H. R. Kricheldorf and W. E. Hull in J Macromol. Sci. Chem., A11(12), pp 2281–2292 (1977).

With regard to the metal salt, it is desirable that it should be soluble in nylon 6.6 since agglomeration is likely to lead to a less uniform effect and perhaps provide nucleating centres for spherulitic crystallisation. It is believed therefore, that compounds with a metal ion exhibiting high charge/radius and an anion with a diffuse charge distribution are particularly suitable. On this basis compounds such as the chlorides, bromides or nitrates of lithium and magnesium are preferred in an amount up to 5%, preferably 2.5%, by weight.

In a further preferred embodiment, the secondary component is incorporated into nylon 6.6 in which there is also incorporated polyethylene glycol. The polyethylene glycol may have a molecular weight of 1,000 to 20,000, preferably 1500 to 10,000.

The invention will now be described with reference to the following examples.

Unless otherwise stated, Relative Viscosity (RV) is measured as an 8.4% by weight solution in 90% formic acid at 25° C.

EXAMPLE 1 (COMPARATIVE)

Nylon 6.6 was prepared in conventional manner by heating a 50% aqueous solution of hexamethylene diammonium adipate (nylon 6.6 salt), with the optional addition of $TiO_2$ in an autoclave. The resulting polymer was cooled and cut into chips.

The chips were dried and subsequently melted in a screw extruder and the molten polymer was fed via a pump to a spinneret at ca 285° C. having one circular hole. The pump was set to deliver polymer at a rate of 8 g/hole/minute.

The resulting filament was cooled by a cross flow of air and wound up at 1 km/min on a winder 4 m below the spinneret.

The results of three such trials are shown in Table 1.

EXAMPLE 2

A random copolymer of 87/13% w/w of nylon 6.6 and hexamethylene diamine/isophthalic acid (6.iP), which on the basis of DSC work appeared to be a suitable co-monomer, was prepared, chipped and melt extruded in the same way as the nylon 6.6 of Example 1.

The results are summarised in Table 2.

EXAMPLE 3

Example 2 was repeated except that the co-monomer was isophorone diamine/isophthalic acid (IPD.iP).

The results are summarised in Table 3.

EXAMPLE 4

Example 2 was repeated except that the co-monomer was caprolactam (6).

The results are shown in Table 4.

EXAMPLE 5

Example 1 was repeated except for the fact that LiCl or LiBr was added at the polymerisation stage.

The results are shown in Table 5.

EXAMPLE 6 (COMPARATIVE)

This example is the comparison for a series of examples in which polymers were processed at high throughput/hole on a full scale spin-draw-bulk-module to make carpet yarns. Processing conditions were selected to ensure that the melt viscosity of the polymer at extrusion was approximately the same in each case.

Nylon 6.6 polymer chips were produced substantially as in Example 1 to give a chip RV of 52. They were dried and subsequently melted in an extruder at ca 290° C. In a first process, the resultant melt was pumped to a spinning pack which included a 68 hole spinneret at ca 284° C. Pumping rate was 306 g/min i.e. 4.5 g/hole/min.

The resulting filaments were cooled in a spinning chimney and converged 4.5 m below the spinneret. Spin finish was applied in the conventional manner and the converged bundle of yarn taken to a feed roll at ca 50° C. After four wraps on the feed roll, surface speed 862 m/min, the yarn was drawn 3.1 times onto a pair of heated draw rolls, surface temperature 195° C., surface speed 2672 m/min. After ten wraps on these rolls yarn was fed to a steam bulking jet. The bulked yarn emerged as a plug onto a cooling drum. The yarn was subsequently unravelled from the plug, intermingled and wound-up as a 1311 dtex 68 filament i.e. 19.3 dpf bulked yarn. This process ran satisfactorily, and the 51.6 RV yarns produced were made into acceptable carpets. However all attempts significantly to increase the throughput/hole via an increase in pump speed failed. The process was unrunnable at 5.5 g/hole/min due to filament breakage.

The procedure was then repeated with a second process to produce 1015 dtex 34 filament bulked yarn i.e. 29.9 dpf. Pumping rate was 153 g/min i.e. again 4.5 g/hole/min. Feed roll speed was 535 m/min, draw roll speed 1766 m/min. The process was just runnable under these conditions but unrunnable at higher speeds corresponding to 5.25 g/hole/min as filament breakage occurred.

EXAMPLE 7

Here 993 dtex 34 filament bulked yarn is made at 7.5 g/hole/min using 92/8% w/w 6.6/6.iP random copolymer. Chips of this random copolymer were prepared to give an RV of 44. These were then melted and pumped at 255 g/min through a 34 hole spinneret i.e. 7.5 g/hole/min and processed via a 931 m/min feed roll, 2795 m/min 185° C. draw roll and a steam bulking jet to give 993 dtex 34 filament, 41RV bulked carpet yarn, which was subsequently made into an acceptable carpet.

EXAMPLE 8

Here Example 7 is substantially repeated using a molecular dispersion of nylon 6 in nylon 6.6.

Chips of nylon 6.6 having an RV of 52 were blended with chips of nylon 6 having an RV of 2.7 (measured as a 1% by weight solution in 96% sulphuric acid) on a 90/10 w/w % basis. These were then melted at 284° C. in a screw extruder and pumped at 255 g/min through a 34 hole spinneret, i.e. 7.5 g/hole/min, and processed via a 847 m/min feed roll, 2795 m/min 195° C. draw roll and a steam bulking jet to give 1001 dtex 34 filament 48 RV bulked carpet yarn which was subsequently made into an acceptable carpet. $^{13}C$ NMR analysis showed no evidence of copolymerisation in the yarn (i.e. if present then less than 2%). The yarn melting point at 263° C., as determined via a Perkin Elmer 7 series DSC7, and coefficient of friction over ceramic surfaces at 0.16 were very little different from those obtained in the 1000 34 decitex filament nylon 6.6 yarn of Example 5 viz 264° C. and 0.15.

EXAMPLE 9

Example 8 was repeated, except that the nylon 6 was replaced by (a) nylon 6.iP and (b) nylon 11. Again there were no processing problems and the yarns were of satisfactory lustre and could be made into acceptable carpets.

EXAMPLE 10

100% nylon 6.6 and an 86/14 w/w % blend of nylon 6.6 and nylon 6 were each spun using the conditions of Example 6. EK. and KB were measured and found to be 17.5% and 40.7% for the nylon 6.6 alone and 19.2% and 38.2% for the blend, showing that the blend matched the nylon 6.6 in terms of both bulk level and bulk stability to tension.

EXAMPLE 11

Various polymers (based on the above examples and as set out below) were spun at a throughput of 5.0 g/hole/minute, drawn 3.1 times and bulked to form 1311 dtex 68 filament yarns.

The polymers used were a) 86/14 w/w % 6.6/6 copolymer b) 87/13 w/w % 6.6/6.iP copolymer c) 86/14 w/w % nylon 6.6 +nylon 6 chip blend The yarns were tufted into carpets which were dyed and then assessed as giving satisfactory performance in terms of resilience, appearance retention, dye light fastness, dye washfastness, rate of dye uptake and flammability.

Similar results were obtained when the example was repeated using 1000 dtex 34 filament yarn spun at 7.5 g/hole/minute.

EXAMPLE 12 (COMPARATIVE)

This example is the comparison for showing the effect of the invention on nylon 6.6 yarn containing an additional component such as polyethylene glycol (which is included to improve the covering power and soil-hiding ability of the yarn).

The first process of Example 6 was repeated except that 5.5% w/w of polyethylene glycol having a molecular weight of 1500 was added to the melt and dispersed using a cavity transfer type mixing device.

The process was found to be unrunnable under the conditions of Example 6 due to filament breakage during the drawing stage.

EXAMPLE 13

Example 12 was repeated using the chip blend of Example 8. No problem of filament breakage was encountered using the conditions of the first process of Example 6 and indeed the draw ratio could be increased to more than 3.3 before any significant breakage occurred.

The throughput/hole was increased to 7.5 g/min in a process similar to that of Example 7 and the process ran satisfactorily.

Similar results were obtained using polyethylene glycols having a range of molecular weights up to 10,000 at addition levels up to 8% by weight.

EXAMPLE 14 (COMPARATIVE)

This example is the comparison for examples in which nylon 6.6 and blends of nylon 6.6 and nylon 6 were processed at high WUS to produce partially oriented yarn (POY) for hosiery purposes.

Nylon 6.6 chips prepared as in Example 1 to give a chip RV of 52 were melted under steam at atmospheric pressure in a screw pressure melter at 290° C. The resulting melt was pumped to a spinning pack which included a 3-hole spinneret at 284° C. The pumping rate was 10.5 g/min i.e. 3.5 g/hole/min.

The resulting filaments were cooled in a spinning chimney and converged 2 meters below the spinneret. Spin finish was applied in a conventional manner and 21 dtex 3 filament yarn wound up at 5000 m/min. Measurement of the lustre gave, at best, an HPW value of 2° which was considered to be just 'on-lustre' and just acceptable for commercial purposes.

When the pumping rate was increased to 4 g/hole/-min in an attempt to produce 24 dtex 3 filament yarn, the HPW value rose dramatically and the resulting yarn was commercially unacceptable.

EXAMPLE 15

Example 14 was repeated except that a chip blend of nylon 6.6 (as in Example 13) and nylon 6 (as in Example 8) on a 91/9 w/w % basis was used and the pumping rate was 4 g/hole/min.

The HPW value of the 24 dtex 3 filament yarn produced was 1.2°.

The example was repeated using a nylon 6.6 to nylon 6 blend ratio of 83/17 w/w % which gave an HPW value of 0.83. The pumping rate was increased to 4.5 g/hole/min in an attempt to produce 28 dtex 3 filament yarn but the HPW value was found to have increased to 3.5°. However, increasing the nylon 6 content to 20 w/w % gave yarn having an HPW value of 0.74°.

EXAMPLE 16

Various polymers containing different amounts of secondary component were spun under the conditions of either Example 1 or Example 14 and the lustre of the resulting yarn measured. The results are shown in Table 6.

EXAMPLE 17

This example makes use of Differential Scanning Calorimetry to assess the effectiveness of the secondary component by determining the fundamental thermal transitions which occur with the polymer as functions of temperature and time.

Samples of polymer chip formed from nylon 6.6 alone as standard and from nylon 6.6 and a secondary component and having a weight of 10.0±0.1 mg were encapsulated in a standard flat DSC sample pan. The chips were selected to be of uniform shape and with at least one flat surface to give maximum contact with the pan for good heat transfer.

The chips were subjected to the following thermal profile heat from 30° C. to 300° C. at 20° C./min.
hold at 300° C. for 2 min.
cool from 300° C. to 30° C. at 20° C./min.

The following measurements were made from the resultant thermogram:

$T_m$=the temperature in °C. corresponding to the peak of the endotherm associated with melting during the heating cycle.

$T_c$=the temperature in °C. corresponding to the peak of the exotherm associated with crystallisation during the cooling cycle.

The measurements were used to calculate the following parameters which gave an indication of the effectiveness of the secondary components.

$(T_m-T_c)$=degree of supercooling $\Delta(T_m-T_c)$=increase in supercooling produced by the secondary component compared to a nylon 6.6 control $$\frac{\Delta(T_m - T_c)}{W} = \text{increase in supercooling per unit weight of the secondary component}$$

$\Delta T_m$=reduction in the melting point compared to a nylon 6.6 control $\Delta T_m/W$=reduction in the melting temperature per unit weight of the secondary component.

The results are shown in Table 7. Clearly, the higher the ratio of $$\frac{\Delta(T_m - T_c)}{W} \text{ to } \frac{\Delta T_m}{W}$$

the greater the potential effect on spherulitic growth and the lesser the likelihood of undesireable effect on other properties of the polymer.

Ideally the ratio should be greater than 0.6 (preferably greater than 0.8 and more preferably greater than 0.95) and $$\frac{\Delta(T_m - T_c)}{W}$$

should be greater than 0.5.

TABLE 1

NYLON 6.6 CONTROLS
8 g/hole/min 1 km/min W.U.S.

| $TiO_2$ w/w % | Spun Yarn RV | Lustre HPW° |
|---|---|---|
| 0 | 53 | 26 |
| 0.03 | 57 | 29 |
| 0.3 | 67 | 31 |

TABLE 2

COPOLYMER 87/13 w/w % 6.6/6.iP
8 g/hole/min 1 km/min W.U.S.

| $TiO_2$ w/w % | Spun Yarn RV | Lustre HPW° |
|---|---|---|
| 0 | 50.5 | 3.5 |
| 0.03 | 56.1 | 3.3 |
| 0.3 | 52.9 | 3.0 |

TABLE 3

6.6/IDP.iP COPOLYMERS
Spun at 8 g/hole/min 1 km/min W.U.S.
(0.3 w/w % $TiO_2$)

| Copolymer Ratio w/w % | Spun Yarn RV | Lustre HPW° |
|---|---|---|
| 92/8 | 50.4 | 3.1 |
| | 48.3 | 3.1 |
| 89/11 | 45.2 | 2.3 |
| | 47.5 | 2.5 |

TABLE 4

NYLON 6.6/6 COPOLYMERS
Spun at 8 g/hole/min 1 km/min W.U.S.
(Nil $TiO_2$)

| Copolymer Ratio w/w % | Melting Point Tm°C. | Spun Yarn RV | Lustre HPW° |
|---|---|---|---|
| 96/4 | 257 | 53 | 29 |
| 90/10 | 245 | 58 | 4 |
| 86/14 | 239 | 52 | 3 |

TABLE 5

| NYLON 6.6 + METAL SALTS Spun at 8 g/hole/min 1 km/min W.U.S. (0.3 w/w % $TiO_2$) | | | |
|---|---|---|---|
| Additive | Level w/w % | Spun Yarn RV | Lustre HPW° |
| LiCl | 1 | 53 | 6.7 |
| | 2 | 40 | 2.2 |
| LiBr | 2 | 34 | 6.5 |
| | 4 | 37 | 3.1 |

TABLE 6

| POLYMER/SPINNING CONDITIONS | LUSTRE (HPW°) AT SECONDARY COMPONENT CONCENTRATION (W/W %) OF | | | | | |
|---|---|---|---|---|---|---|
| | 0 | 5 | 10 | 13 | 15 | 20 |
| Nylon 6.6/Nylon 6 Copolymer - Exampe I | 30 | 30 | 4 | — | 3 | 2.5 |
| Nylon 6.6/Nylon 6.iP Copolymer - Exampe I | 30 | — | — | 3 | — | 1.5 |
| Nylon 6.6 + Nylon 6.iP Blend - Example I | 32 | 34 | 24 | — | 15 | 7 |
| Nylon 6.6 + Nylon 6 Blend - Example 13 | 2.6 | 1.4 | 0.9 | — | 0.9 | — |

TABLE 7

| SECONDARY COMPONENT (X) | w/w % | $T_m$°C. | $T_c$°C. | $T_m - T_c$°C. | $(T_m - T_c)$ | $(T_m - T_c)/w$ (A) | $T_m$ | $T_m/w$ (B) | A/B |
|---|---|---|---|---|---|---|---|---|---|
| Control | 0 | 264 | 222 | 42 | 0 | 0 | 0 | 0 | — |
| Caprolactam (6) | 5.26 | 252 | 207 | 45 | 3 | 0.6 | 12 | 2.3 | 0.2 |
| Hexamethylene diamine/Isophthalic Acid (6.iP) | 10.79 | 252 | 198 | 54 | 12 | 1.1 | 12 | 1.1 | 1.0 |
| Tetramethylene Diamine Adipic Acid (4.6) | 8.87 | 254 | 211 | 43 | 1 | 0.1 | 10 | 1.1 | 0.1 |
| Hexamethylene diamine/Sebacic Acid (6.10) | 12.18 | 252 | 205 | 47 | 5 | 0.4 | 1 | 1.0 | 0.4 |
| Metaxylylene Diamine/Adipic Acid (MXD.6) | 10.79 | 255 | 206 | 49 | 7 | 0.6 | 9 | 0.8 | 0.8 |
| Isophorone Diamine/Isophthalic Acid (IPD.iP) | 12.85 | 238 | 175 | 63 | 21 | 1.6 | 26 | 2.0 | 0.8 |
| Hexamethylene diamine/Dodecanedioc Acid (61.2) | 13.23 | 252 | 210 | 42 | 0 | 0 | 12 | 0.9 | 0 |
| Isophorone Diamine/Terephthalic Acid (IPD.T) | 12.85 | 262 | 218 | 44 | 2 | 0.2 | 2 | 0.2 | 1.0 |
| Bis (aminomethyl) tricyclodecane/ Terephthalic Acid (TCD.T) | 13.74 | 250 | 199 | 51 | 9 | 0.7 | 14 | 1.0 | 0.7 |
| Hexamethylene diamine/1,1,3-trimethyl-3-Phenyl Indane 4,5 Dicarboxylic Acid (6.PIDA) | 16.58 | 252 | 200 | 52 | 10 | 0.6 | 12 | 0.7 | 0.8 |
| Bis (aminomethyl) tricyclodecane/ Isophthalic Acid (TCD.iP) | 13.74 | 241 | 182 | 58 | 16 | 1.2 | 23 | 1.7 | 0.7 |
| Lithium Chloride | 2.00 | 248 | 189 | 59 | 17 | 8.5 | 16 | 8.0 | 1.1 |
| Lithium Chloride | 1.00 | 256 | 208 | 48 | 6 | 6.0 | 8 | 8.0 | 0.8 |

We claim:

1. A method for producing a nylon yarn comprising the steps of:
   a) polymerizing a mixture of nylon 6.6 salt and a second nylon salt selected from the group consisting of hexamethylene diamine/isophthalic acid, hexamethylene diamine/1,1,3-trimethyl-3-phenyl indane 4,5 dicarboxylic acid, isophorone diamine/isophthalic acid, bis(aminomethyl) tricyclodecane/isophthalic acid, bis (aminomethyl) tricyclodecane/terephthalic acid and meta-xylylene diamine/adipic acid to form a random copolymer;
   b) extruding the random copolymer through a spinneret to form filaments at a rate of at least 4.5 g/hole/min. for carpet filaments having a decitex per filament of at least 15 or at a rate of at least 3.5 g/hole/min. for textile POY filaments having a decitex per filament less than 15; and
   c) converging the filaments to form a yarn.

2. The method of claim 14 wherein the amount of the second nylon salt in the mixture is from 5 to 30 percent by weight.

3. A method for producing a nylon yarn comprising the steps of:
   a) mixing molten nylon 6.6 polymer with a second molten polymer selected from the group consisting of nylon 6, nylon 11, nylon 12, nylon 6.10 and nylon 6. iP to form a molecular dispersion having a degree of copolymerization of less than 2 percent;
   b) extruding the molecular dispersion through a spinneret to form filaments at a rate of at least 4.5 g/hole/min. for carpet filaments having a decitex per filament of at least 15 or at a rate of at least 3.5 g/hole/min. for textile POY filaments having a decitex per filament less than 15; and
   c) converging the filaments to form a yarn.

4. The method of claim 3 wherein the amount of the second polymer in the molecular dispersion is from 5 to 30 percent weight.

5. A method for producing a nylon yarn comprising the steps of:
   a) mixing molten nylon 6.6 polymer with a metal salt which is soluble in nylon 6.6 polymer, said metal salt being formed from a metal cation and an anion, said metal cation being selected from the group consisting of lithium ion and magnesium ion, said anion being selected from the group consisting of chloride, bromide and nitrate;
   b) extruding the resulting mixture through a spinneret to form filaments at a rate of at least 4.5 g/hole/min. for carpet filaments having a decitex per filament of at least 15 or at a rate of at least 3.5 g/hole/min. for textile POY filaments having a decitex per filament less than 15; and
   c) converging the filaments to form a yarn.

6. The method of claim 5 wherein up to 5 weight percent of said metal salt is mixed with the molten nylon 6.6 polymer.

7. The method of any one of claims 1-6 in which from 1 to 10 percent by weight polyethylene glycol is also incorporated into the nylon 6.6.

8. A method according to claim 7, in which the polyethylene glycol has a molecular weight of 1,000 to 20,000.

9. A method according to claim 8, in which the polyethylene glycol has a molecular weight of 1,500 to 10,000.

* * * * *